United States Patent [19]

Rogo et al.

[11] Patent Number: 4,544,325

[45] Date of Patent: Oct. 1, 1985

[54] VARIABLE GEOMETRY DEVICE FOR TURBINE COMPRESSOR OUTLET

[75] Inventors: Casimir Rogo, Mt. Clemens; Herman N. Lenz, Lambertville, both of Mich.

[73] Assignee: Teledyne Industries, Inc., Los Angeles, Calif.

[21] Appl. No.: 199,475

[22] Filed: Oct. 22, 1980

[51] Int. Cl.[4] ..... F01B 25/02; F04D 15/00

[52] U.S. Cl. ..... 415/150; 415/46; 415/211

[58] Field of Search ..... 415/46, 47, 148, 150, 415/211

[56] References Cited

U.S. PATENT DOCUMENTS

| | | | |
|---|---|---|---|
| 2,739,782 | 3/1956 | White . | |
| 2,763,426 | 9/1956 | Erwin . | |
| 2,996,996 | 8/1961 | Jassniker | 415/150 |
| 3,365,120 | 1/1968 | Jassniker . | |
| 3,406,740 | 10/1968 | Samerdyke . | |
| 3,478,955 | 11/1969 | Kunderman . | |
| 3,489,391 | 1/1970 | Kanger et al. | 415/157 |
| 3,829,237 | 8/1974 | Chestnutt | 415/181 |
| 3,887,295 | 6/1975 | Yu | 415/116 |
| 3,975,911 | 8/1976 | Morgulis et al. . | |
| 3,994,620 | 11/1976 | Spraker, Jr. et al. . | |
| 4,149,826 | 4/1979 | Torstenfelt | 415/127 |

FOREIGN PATENT DOCUMENTS

| | | | |
|---|---|---|---|
| 1208697 | 2/1960 | France | 415/150 |

*Primary Examiner*—Philip R. Coe
*Assistant Examiner*—Timothy F. Simone
*Attorney, Agent, or Firm*—Gifford, VanOphem, Sheridan, Sprinkle & Nabozny

[57] ABSTRACT

A variable geometry device is provided for use with the compressor outlet of a turbine engine. The turbine engine includes a support housing, a compressor contained within the support housing and having a compressed air outlet and in which a pair of spaced walls define an annular and radially extending diffuser passageway. The inner end of the diffuser passageway is open to the compressed outlet while the outer end of the diffuser passageway is open to the combustion chamber for the turbine engine. A plurality of circumferentially spaced diffuser vanes are mounted to one of the diffuser walls and protrude across the diffuser passageway. An annular recessed channel is formed around the opposite diffuser wall and an annular ring is mounted within the channel. A motor is operatively connected to this ring and, upon actuation, displaces the ring transversely across the diffuser passageway to variably restrict the diffuser passageway. In addition, the ring includes a plurality of slots which register with the diffuser vanes so that the vane geometry remains the same despite axial displacement of the ring.

6 Claims, 3 Drawing Figures

VARIABLE GEOMETRY DEVICE FOR TURBINE COMPRESSOR OUTLET

The invention described herein was made in the performance of work under NASA Contract No. NAS 3-23163 and is subject to the provisions of Section 305 of the National Aeronautics and Space Act of 1958 (72 Stat. 435; 42 U.S.C. 2457).

BACKGROUND OF THE INVENTION

I. Field of the Invention

The present invention relates generally to variable geometry devices employed in turbine engines and, more particularly, to such a device for use in the diffuser passageway between the turbine engine compressor outlet and the combustion chamber.

II. Description of the Prior Art

A conventional turbine engine includes a support housing, a compressor having an outlet rotatably mounted within the support housing and a diffuser passageway which fluidly connects the compressor outlet to a combustion chamber also contained within the support housing. In many previously known turbine engines, the diffuser passageway is generally annular in shape having its inner end open to the compressor outlet so that the air flow through the diffuser passageway is generally radially outward. In addition, many of the previously known turbine engines include diffuser vanes extending across the diffuser passageway to aerodynamically control the flow of compressed air from the compressor and to the combustion chamber.

Many turbine engine applications require that the turbine engine be operated over a broad range of operating conditions. These different operating conditions in turn entail different air flow and pressure delivery requirements. Moreover, it is desirable to maintain high turbine engine performance, and thus turbine engine efficiency, at all of the operating conditions which, in turn, avoids surge, cavitation and other engine instabilities.

One previously known method of broadening the flow capacity characteristics in the diffuser passageway is to use variable geometry engine components. In the case of centrifugal compressors, the desired variable geometry for the diffuser assembly is typically accomplished by varying the angle of the diffuser vanes in the diffuser passageway.

The previously known pivoted diffuser vanes, however, have not proven wholly satisfactory in use to vary the diffuser geometry. One disadvantage of this method results from the leakage losses which occur in the diffuser assembly around the pivoted diffuser vanes and into the support housing. These clearance losses are further amplified due to the large openings in the diffuser walls which are required to compensate for thermal distortion and thermal expansion.

A still further disadvantage of the use of pivoted diffuser vanes to vary the aerodynamic geometry of the diffuser passageway is that it is difficult to accurately pivot all of the diffuser vanes to the same angle due to mechanical back-lash and mechanical play. Unwanted and undesired turbulences result when the diffuser vanes are positioned at different angles.

SUMMARY OF THE PRESENT INVENTION

The present invention provides a variable geometry device for use in the diffuser passageway of the turbine engine which overcomes the disadvantages of the previously known variable geometry devices.

In brief, in the present invention two spaced walls in the support housing form an annular diffuser passageway having its inner end open to the compressor outlet. The outer end of the diffuser passageway is fluidly connected to the combustion chamber for the turbine engine. In addition, a plurality of circumferentially spaced diffuser vanes are secured to one support housing wall and extend transversely or axially across the diffuser passageway.

An annular channel is formed around the entire circumfery of the other diffuser wall. Thereafter, a ring is mounted within this channel and moving means are attached to the ring for moving the ring between a retracted and extended position.

In its retracted position, the ring is nested within the channel so that one face of the ring is substantially flush with the wall of the diffuser passageway. Conversely, in its extended position, the ring protrudes into and restricts the diffuser passageway.

In the preferred form of the invention, the ring has a plurality of circumferentially spaced slots so that one slot registers with and receives one diffuser vane therein. Thus, the diffuser vane geometry remains fixed regardless of the position of the ring.

BRIEF DESCRIPTION OF THE DRAWING

A better understanding of the present invention will be had upon reference to the following detailed description when read in conjunction with the accompanying drawing wherein like reference characters refer to like parts throughout the several views, and in which.

DETAILED DESCRIPTION OF A PREFERRED EMBODIMENT OF THE PRESENT INVENTION

Figure 1:
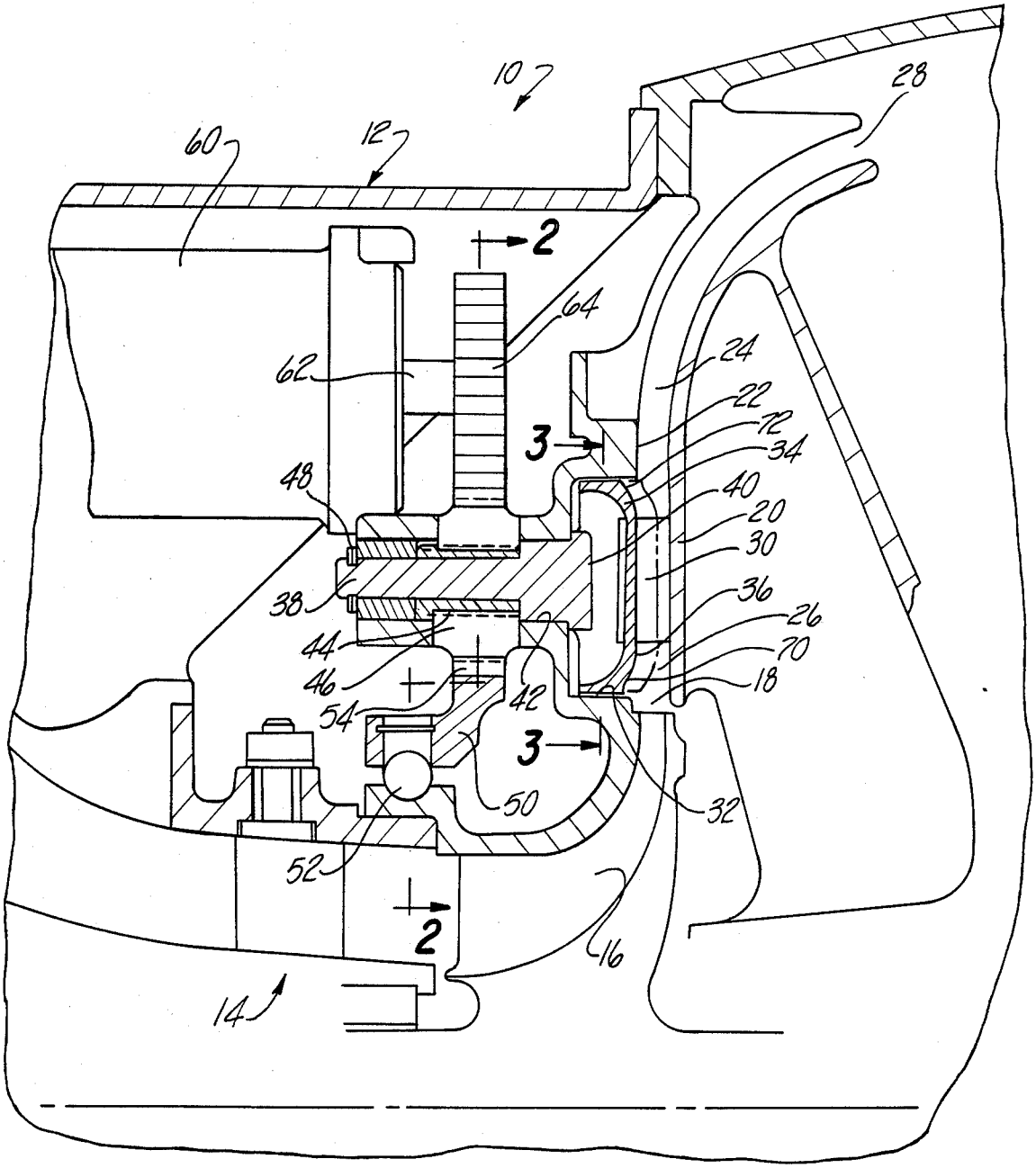
FIG. 1 is a fragmentary sectional view illustrating a preferred embodiment of the variable geometry device of the present invention.

With reference first to FIG. 1, a portion of a turbine engine 10 is thereshown and comprises a support housing 12 in which an air compressor means 14 is rotatably mounted. The air compressor means 14 also includes a final stage 16 open to a compressed air outlet 18.

The support housing 12 includes a first annular diffuser wall 20 and a second annular diffuser wall 22 which, together, form an annular diffuser passageway 24 within the support housing 12. The inner end 26 of the diffuser passageway 24 is open to and registers with the compressor outlet 18 while the outer end 28 of the diffuser passageway 24 is open to a combustion chamber (not shown). Thus, in the well known fashion, the diffusor passageway 24 fluidly connects the compressor outlet 18 with the combustion chamber of the turbine engine 10.

Figure 3:
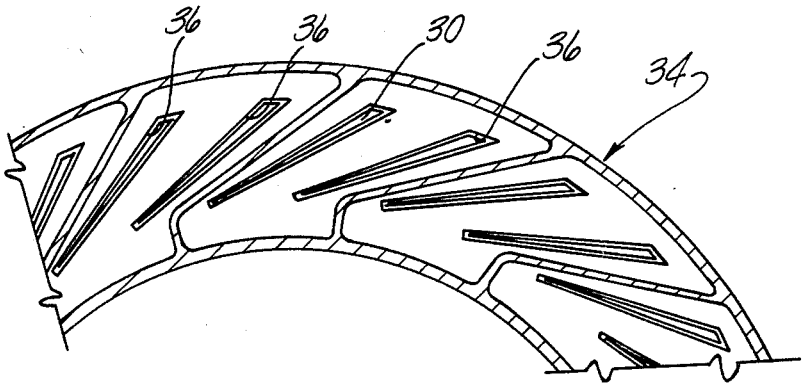
FIG. 3 is a fragmentary sectional view taken substantially along line 3—3 in FIG. 1.

With reference now to FIGS. 1 and 3, a plurality of circumferentially spaced diffuser vanes 30 are secured to the diffuser wall 20 and extend entirely axially across the diffuser passageway 24. These diffuser vanes 30 are of a fixed geometry and aerodynamically shape the air flow from the compressor outlet 18 and to the combustion chamber.

Still referring to FIGS. 1 and 3, an annular recessed channel 32 having a generally rectangular cross sectional shape is formed around the entire circumfery of the diffuser wall 22. A ring 34 having a front face 36 is then positioned within the channel 32 so that the ring 34 also extends entirely around the diffuser passageway 24. The ring 34 is of a rigid construction and is preferably formed by casting. In addition, the ring 34 has a plurality of circumferentially spaced slots 36 (FIG. 3) formed through it so that one slot 36 registers with and receives one diffuser vane 30 therein.

Figure 2:
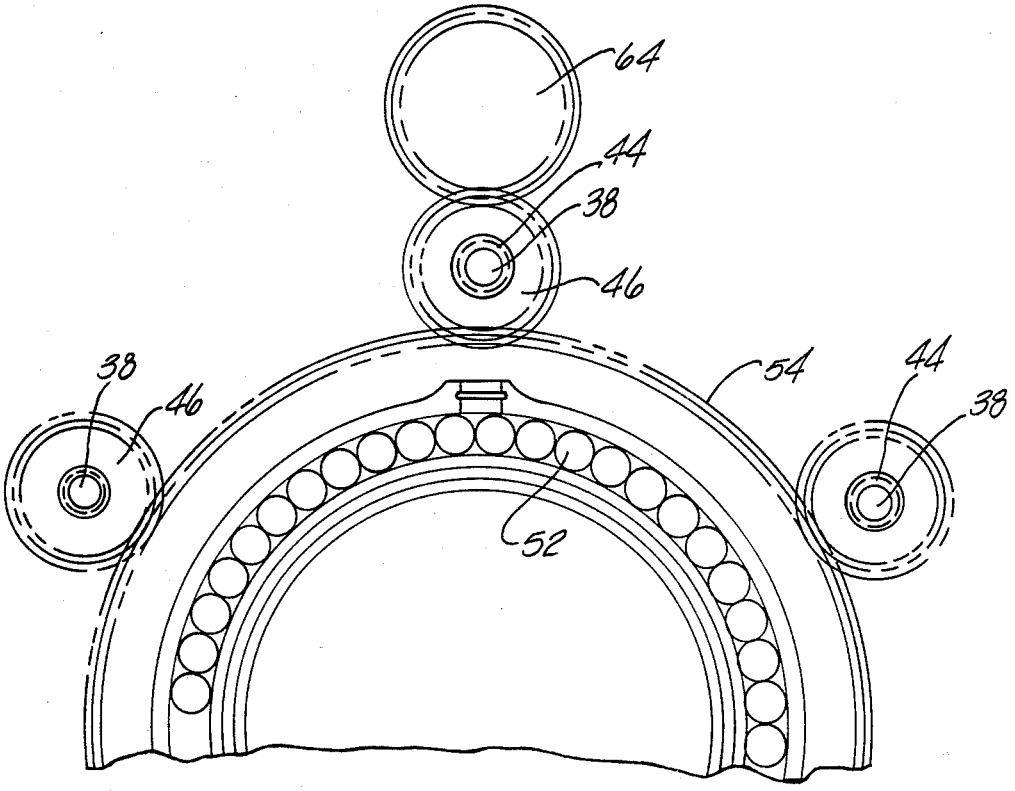
FIG. 2 is a fragmentary sectional view taken substantially along line 2—2 in FIG. 1.

With reference now to FIGS. 1 and 2, a plurality of circumferentially spaced pins 38 are secured at one end 40 to the ring 34 and each pin extends axially outwardly through an opening 42 in the base of the channel 32. The pin 38 furthermore include an externally threaded portion 44 along their length and the pins 38 can be either integrally formed with the ring 34 or separately fabricated and secured to the ring 34. In addition, the pins 38 are free to axially slide in the opening 42 and, in doing so, axially displace the ring 34 transversely across the diffuser passageway 24.

In order to control the axial position of the pin 38, and thus of the ring 34, an internally threaded pinion 46 is threadably attached to the threaded portion 44 of each pin 38. Each pinion 46 is axially constrained with respect to the support housing 12 by a retainer 48 so that rotation of the pinion 46 axially displaces the pin 38 and the ring 34 due to the threaded connection between each pinion 46 and its associated pin 38.

A gear ring 50 is rotatably mounted to the support housing 12 by a ball bearing assembly 52 so that the gear ring 50 rotates concentrically around the compressor assembly 14. The teeth 54 of the gear ring 50 mesh with the inner radial ends of the pinions 46.

With reference still to FIGS. 1 and 2, a motor 60 is contained within the support housing 12 and includes an output shaft 62 on which a drive gear 64 is secured. The drive gear 64, in turn, is in mesh with one of the pinions 46. The motor 60 is a reversible motor and is of any conventional construction, such as an electric or hydraulic motor.

With reference now particularly to FIG. 1, in operation, rotation of the drive gear 64 by the motor 60 rotatably drives one of the pinions 46. This, in turn, rotates the gear ring 50 on its ball bearing assembly 52 in dependence upon the direction of rotation of the motor 60. Since the gear ring 50 is in mesh with each of the pinions 46, all of the pinions 46 rotate in unison with each other.

The rotation of the pinions 46 axially displaces the pins 38 with their attached ring 34 due to the threaded engagement between each pinion 46 and its associated pin 38. Thus, the ring 34 moves transversely across the diffuser passageway 24 between a retracted position, shown in solid line in FIG. 1, and an extended position, shown in phantom line in FIG. 1. In its retracted position, the ring 34 is nested within the channel 32 so that its front face 36 is substantially flush with the diffuser wall 22. Conversely, with the ring 34 in its extended position, the ring 34 restricts the diffuser passageway 24 without altering the geometry of the diffuser vanes 30 due to the sliding engagement of the vanes 30 in the ring slots 36.

The provision of the circumferentially spaced pins 38 prevents the ring from tilting and ensures that all portions of the ring protrude into the diffuser passageway 24 by the same amount.

As is shown in FIG. 1, both the inner radial end 70 and outer radial end 72 of the ring 34 are tapered inwardly toward the diffuser side wall 22. Thus, with the ring 34 in its extended position, both the inner radial and outer radial ends of the ring 34 taper toward and meet the diffuser side wall 22. The tapered portions 70 and 72 of the ring 34 are designed to minimize air turbulence through the diffuser passageway 24 when the ring 34 is in its extended position.

From the foregoing, it can be seen that the present invention provides a novel construction for varying the aerodynamic geometry of the diffuser passageway in a turbine engine without varying the geometry or angle of the diffuser vanes. Moreover, the device of the present invention is compact in construction and virtually fail safe in operation.

A still further advantage of the present invention is that leakage losses, a major disadvantage of the previously known pivotal diffuser vane constructions, is virtually entirely eliminated. Any leakage through the ring slots 36 is simply returned to the diffuser air flow and ultimately to the combustion chamber.

Having described our invention, however, many modifications thereto will become apparent to those skilled in the art to which it pertains without deviation from the spirit of the invention as defined by the scope of the appended claims.

We claim:

1. A compressor assembly for a turbine engine comprising:

a support housing, a compressor means contained within the support housing and having a compressed air outlet;

said support housing having a pair of spaced diffuser walls which form an annular diffuser passageway having its inner end open to said compressed air outlet, said diffuser passageway having an annular recessed channel formed along one diffuser wall, a ring mounted in said channel, means for moving said ring transversely across said passageway between a retracted position in which said ring is nested within said channel and an extended position in which one side of said ring protrudes into and restricts said diffuser passageway, a plurality of circumferentially spaced pins secured to and extending axially outwardly from the other side of said ring and through an opening in said channel, each pin having an external threaded portion along its length and wherein said moving means comprises a plurality of internally threaded pinions, one pinion threadably engaging each pin, means for restraining said pinions against axial movement, a gear ring rotatably mounted to said housing coaxially with said ring, said gear ring being in mesh with said pinions, a drive gear in mesh with one of said pinions, and motor means for rotatably driving said drive gear.

2. The invention as defined in claim 1 and further comprising a plurality of circumferentially spaced vanes secured to the other diffuser wall and protruding into said diffuser passageway and wherein said ring includes a plurality of slots which register with and slidably receive said vanes.

3. The invention as defined in claim 2 wherein said vanes extend entirely transversely across said diffuser passageway and into said slots when said ring is in its retracted position.

4. The invention as defined in claim 1 wherein the center of said one side of said ring is substantially flush with said one diffuser wall when said ring is in its retracted position.

5. The invention as defined in claim 4 wherein said ring includes a tapered portion adjacent both the inner and outer radial ends of said ring which tapers from said one ring side and toward said one diffuser wall.

6. The invention as defined in claim 5 wherein the inner and outer radial ends of said one side of said ring substantially register with said one diffuser wall when said ring is in said extended position.

* * * * *